United States Patent [19]

Morsette

[11] Patent Number: 4,727,855

[45] Date of Patent: Mar. 1, 1988

[54] FIREPLACE ASH DISPOSAL DEVICE

[76] Inventor: Victor Morsette, 1003 50th Ave., North, Nashville, Tenn. 37209

[21] Appl. No.: 15,994

[22] Filed: Feb. 18, 1987

[51] Int. Cl.[4] ..... F23J 1/00

[52] U.S. Cl. ..... 126/242

[58] Field of Search ..... 126/143, 242; 193/2 R, 193/33, 34

[56] References Cited

U.S. PATENT DOCUMENTS

| | | | |
|---|---|---|---|
| 260,199 | 6/1882 | Howard | 126/242 |
| 1,786,453 | 12/1930 | Risdon | 126/120 |
| 2,470,430 | 5/1949 | Carter | 126/143 |
| 2,481,878 | 9/1949 | Robinson | 126/242 |

FOREIGN PATENT DOCUMENTS

| | | | |
|---|---|---|---|
| 58453 | 9/1946 | Netherlands | 193/33 |
| 28089 | of 1910 | United Kingdom | 126/143 |

*Primary Examiner*—Samuel Scott
*Assistant Examiner*—Allen J. Flanigan
*Attorney, Agent, or Firm*—Harrington A. Lackey

[57] ABSTRACT

An ash disposal device having an elongated base member with a top sweep surface mounted transversely along the front of and flush with the floor of a fireplace, an ash opening through the sweep surface communicating with a depending ash chute below the base member, and a lid member hinged to the base member for opening and closing the sweep surface and the ash opening.

8 Claims, 5 Drawing Figures

FIREPLACE ASH DISPOSAL DEVICE

BACKGROUND OF THE INVENTION

This invention relates to an ash disposal device, and more particularly an ash disposal device mounted along the front edge portion of a fireplace floor.

Most conventional fireplaces have ash openings covered by pivotally mounted dampers or ash doors and communicating with the basement through a chute or passage below the fireplace Some of these ash passages extend through the basement wall to the outside of the house, with the ash discharge opening covered by a hinged door. Such conventional ash openings are usually located in the center or toward the rear of the floor of the fireplace.

It is also known to provide openings through the fireplace floor or walls which are connected to air passages for the introduction of draft air into the fireplace to improve the combustion of the fuel.

Various ash or air conduits communicating with the floor of a fireplace or other heating apparatus are disclosed in the following U.S. patents:

| | | |
|---|---|---|
| 42,804 | Stoner | May 17, 1864 |
| 80,455 | Coates | July 28, 1868 |
| 161,724 | Winfield | Apr. 6, 1875 |
| 186,013 | Linsley | Jan. 9, 1877 |
| 217,197 | Butz | July 8, 1879 |
| 347,522 | Schoen | Aug. 17, 1886 |
| 2,470,430 | Carter | May 17, 1949 |
| 4,186,719 | Dalsin | Feb. 5, 1980 |

All of the above patents, except Dalsin, disclose receptacles or chutes for the removal of ashes from a fireplace or furnace.

Winfield, Carter, and Dalsin disclose chutes in the fireplace which are used for conveying air to the fireplace and/or the removal of ashes.

Linsley discloses a sliding fender or ash flue cover B adapted to slide over an opening in the hearth in order to open and close the opening for either the removal or the retention of ashes.

Winfield, Carter, and Dalsin all disclose hinged covers for the chutes or openings in the hearth.

The Winfield patent discloses a combination ash and air conduit extending up through the center part of the floor of the fireplace. The ash flue F in the Linsley patent also communicates with the fireplace through the center portion of the fireplace floor.

Although the Dalsin U.S. Pat. No. 4,186,719 discloses an elongated, rectangular box fitted into an opening in the front of the fireplace floor, and is provided with a hinged top cover, nevertheless, the duct 30 leading away from the box will permit only the introduction of air and is not suitable for the elimination of ashes by gravity, since the duct 30 is horizontal.

The Carter U.S. Pat. No. 2,470,430 discloses a variety of both ash disposal chutes and draft inlet passages for a fireplace. Although FIG. 6 of Carter discloses a nozzle 5 in the front portion of the fireplace floor purportedly for the discharge of ashes and a hinged lid 8, nevertheless, the projection of the nozzle 5 above the horizontal plane of the fireplace floor 2, and the hinged connection of the lid to the rear edge of the nozzle, present barriers to the sweeping of ashes forward into the nozzle 5.

None of the above patents disclose an ash disposal device having a sweep surface extending transversely along, and coplanar with, the front of the fireplace floor, and an ash opening in the sweep surface to facilitate the sweeping of ashes forward from the fireplace into the opening. Moreover, such patents do not disclose such a sweep surface with a hinged lid for closing the ash opening and for opening the ash opening to provide a sweep barrier to prevent the swept ashes from entering the living area in front of the fireplace.

SUMMARY OF THE INVENTION

It is therefore an object of this invention to provide an ash disposal device particularly adapted for mounting across and along the front edge portion of a fireplace floor to facilitate the sweeping of ashes from the fireplace floor into the ash opening of the disposal device.

Another object of this invention is to provide an ash disposal device having an elongated sweep surface with an ash opening therein mounted along the front edge of, and coplanar with, the fireplace floor to facilitate the sweeping of ashes forward from the fireplace floor, upon the sweep surface, and into the ash opening.

Another object of this invention is to provide an ash disposal device adapted to be mounted transversely along the front edge of the fireplace floor, including an ash opening and also a hinged lid member which is hinged along the front edge portion of the sweep surface and in front of the ash opening to provide a barrier to confine the swept ashes to the sweep surface and to prevent the ashes from entering the living area in front of the fireplace opening.

A further object of this invention is to provide an ash disposal device including an assembly of an elongated transverse sweep surface, an ash opening in the sweep surface an ash chute depending from the opening, a hinged cover for closing the ash opening in its closed position and for providing an ash barrier in its open position, and mounting frame members for mounting the disposal device in the hearth in front of the fireplace floor.

A further object of this invention is to provide an ash disposal device which may be mounted in front of the fire-place opening during the original construction of the building containing the fireplace, or may be installed in front of a fireplace after the building and the fireplace have been constructed.

Another object of this invention is to provide an ash disposal device including an elongated sweep surface mounted in front of and coplanar with the fireplace floor including one or more ash openings and corresponding depending ash chutes.

DESCRIPTION OF THE PREFERRED EMBODIMENTS

Figures 1, 2, 3, 4, 5:
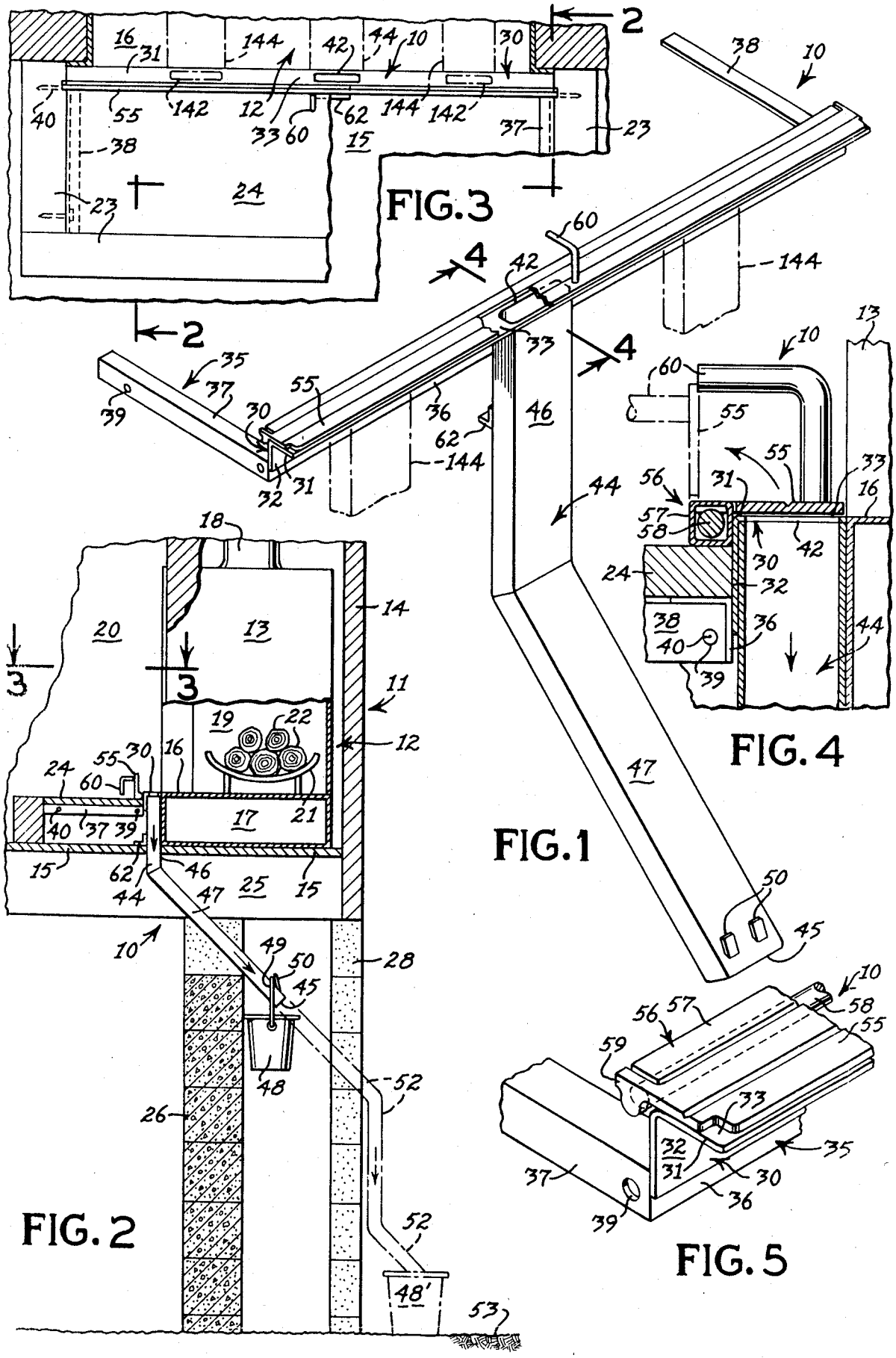
FIG. 1 is a front and top perspective view of the ash disposal device made in accordance with the invention, with portions of the lid member broken away.
FIG. 2 is a sectional elevation of a fireplace and the portion of the building supporting the fireplace, in which the ash disposal device disclosed in FIG. 1 is mounted in operative position, with the lid member in its open position, and taken along the line 2—2 of FIG. 3.
FIG. 3 is an enlarged fragmentary section taken along the line 3—3 of FIG. 2.
FIG. 4 is an enlarged fragmentary section taken along the line 4—4 of FIG. 1, with the lid member in its solid-line closed position, and in its phantom open position.
FIG. 5 is an enlarged fragmentary perspective view of one end portion of the device disclosed in FIG. 1.

Referring now to the drawings in more detail, FIGS. 2, 3, and 4 disclose a fireplace ash disposal device 10, made in accordance with this invention, installed in a building, such as the house 11, in operative position in front of a fireplace 12 to facilitate the removal of ashes from the fireplace.

Although the fireplace 10 can be used for conventional masonry fireplaces, nevertheless, it is disclosed in the drawings as being in the form of a pre-manufactured steel fireplace or combustion chamber insert assembly 13, such as a "Majestic" fireplace. The fireplace insert device 13 is supported within the fireplace area 12 adjacent the back wall 14 of the house 11 and supported upon the sub-floor 15. The horizontal planar fireplace floor 16 is spaced above the bottom of the furnace insert 13 to form an air plenum 17.

The top of the fireplace insert device 13 communicates with a chimney 18, and includes a combustion chamber 19 which opens forward into the living area 20. Resting upon the fireplace floor 16 is a grate 21 supporting the fuel such as logs 22.

Located in front of the fireplace 12 is the hearth 24. The sub-floor 15 is supported upon the spaced floor joists 25, which in turn is supported upon the foundation wall 26. Additional support in the form of a wall 28, having an opening, not shown, defines an ash chamber beneath the fireplace 12.

The hearth 24 may be contained and supported within the hearth frame 23 (FIG. 3).

The ash disposal device 10 made in accordance with this invention includes an elongated base member 30, shown in the drawings as being made of a single length of angle iron having a top horizontal flange 31 and a depending vertical flange 32. The top surface of the horizontal flange 31 defines an elongated planar sweep surface 33, which preferably extends substantially the width of the fireplace opening at the front edge of the fireplace floor 16.

The base member 30 is mounted along the front edge of the fireplace floor 16 by a mounting bracket 35 including an elongated, transverse angle frame member 36, welded to the bottom portion of the vertical flange 32 of the base member 30, as best disclosed in FIG. 4. The mounting bracket 35 further includes a pair of forward projecting frame members or legs 37 and 38, the rear ends of which are welded to the opposite ends of the transverse bracket frame member 36. The frame legs 37 and 38 are provided with fastener apertures 39 through which fasteners, such as nails 40, may be extended for securing the legs 37 and 38 to corresponding wooden frame members of the hearth frame 23, and beneath the hearth 24.

Formed through the sweep surface 33, including the top horizontal flange 31 of the base member 30, is one or more elongated ash openings or slots 42.

Fixed to and depending from the bottom of the horizontal flange 31 is an elongated ash chute 44 having an upper open end portion in registry with the ash opening 42, and a bottom open end portion 45 functioning as the discharge ash opening.

The ash chute 44 may be shaped to include a depending vertical upper chute section 46 and an angular declining lower chute section 47. The lower chute section 47 is directed through the foundation wall 26 for discharge of the ashes through the opening 45 into a receptacle or bucket 48 (FIG. 2). The bail 49 of the bucket 48 is suspended over a hook attachment 50 fixed to the lower portion of the chute section 47 adjacent the discharge opening 45, as best disclosed in FIG. 2.

The chute section 47 could be directed vertically downward to discharge ashes inside the foundation wall 26, if desired.

Also, as illustrated in FIG. 2, the lower chute section 47 may be provided with extension sections 52, shown in phantom, for discharge of the ashes into a receptacle 48' seated on the outside ground 53.

An elongated flap or planar lid member 55, preferably as long as the base member 30, is adapted to lie flush upon the sweep surface 33 in order to close the ash discharge opening 42.

The front edge portion of the lid member 55 is journaled to the corresponding front edge portion of the sweep surface 33 for swinging movement between the closed position disclosed in solid lines in FIGS. 1, 4, and 5, and an open position disclosed in solid lines in FIGS. 2 and 3, and the phantom position of FIG. 4. The particular hinge mechanism 56 utilized for pivotally connecting the lid member 55 to the top flange 31 includes an elongated tubular journal member 57 having openings at opposite ends to provide journal sockets for receiving inwardly directing hinge pins 58 of the gudgeons 59 fixed to the opposite ends of the lid member 55. Other types of journal or hinge mechanisms may be utilized for pivotally connecting the lid member 55 to the top flange 31 of the base member 30, if desired.

A handle member 60 may be fixed to the top of the lid member 55, if desired, to facilitate raising and lowering the lid member 55. Other types of handle members may also be used, if desired.

As part of the mounting means for the device 10, a transverse lip 62, disclosed in the form of an angle piece in FIGS. 1 and 2, is fixed to the front surface of the upper chute section 46 at a predetermined elevation below the upper end of the chute section 46. When the lip 62 is seated upon the sub-floor 15, as illustrated in FIG. 2, the chute 44 is properly positioned so that the sweep surface 33 is substantially flush with the fireplace floor 16. The lip 62 may be secured to the sub-floor 15 by fasteners, such as nails, not shown.

In the installation of the device 10, the base member 30 is located across the front of the fireplace 12 at floor level, with the top sweep surface 33 being coplanar with the fireplace floor 16, so that in effect, the sweep surface 33 is a forward coplanar extension of the floor. The device 10 is then fixedly mounted in this position by securing frame legs 37 and 38 to corresponding sub-structure, such as the hearth frame 23. In this position, the lip member 62 is seated upon the top surface of the sub-floor 15, or any other appropriate sub-structure. For varying sub-structures, other appropriate mounting means may be employed for securing the device 10 in its fixed position. In the installed position, the lid member 55 is free to swing between its closed position, as disclosed in solid lines in FIG. 4, and its open phantom position, with the hinge mechanism 56 being located in front of the ash opening 42.

The chute 44 extends downward below the fireplace floor 16 and the sub-floor 15 to permit discharge of the ashes falling through the ash opening 42 and the chute 44 into an appropriate receptacle or pile, either inside or outside of the foundation wall 26. As disclosed in the drawings, the lower angular chute section 47 extends outside of the main foundation wall 26 to discharge ashes through the discharge opening 45 into a receptacle or bucket 48 hung upon the bail hook 50. Alternatively, the lower section 47 may be provided with chute sections 52 for extending the effective length of the chute 44 beyond the outer wall 28, as disclosed in phantom in FIG. 2.

Normally, the lid member 55 will lie in its closed position, flat or flush upon the sweep surface 33, as disclosed in FIGS. 1, 4, and 5.

When it is desired to remove ashes from beneath the grate 21 lying upon the fireplace floor 16, the handle 60 is grasped and lifted to raise upward and forward the lid member 55 in order to fully expose the ash opening 42. Moreover, the lid member 55 is preferably retained in its upright position, as disclosed in solid lines in FIGS. 2 and 3 and in phantom in FIG. 4, so that the lid member 55 functions as an ash barrier. As the ashes are swept forward from the fireplace floor 16 toward the device 10, they are barred from further forward passage by the upraised lid member 55. The ashes are then swept not only forward, but laterally toward the ash opening 42 until all of the ashes have been removed from the fireplace floor 16 and also from the sweep surface 33.

In order to expedite the removal of ashes, more than one ash opening 42 may be formed in the top horizontal flange 31, as illustrated by the extra ash openings 142 in FIG. 3. Moreover, each of the additional ash openings 142 are provided with corresponding chutes 144, also as illustrated in FIG. 3. These chutes 144 may be directed downward and rearward in the same manner as the chute 44, or they may converge toward each other and into the existing chute 44, so that all of the ashes falling through all of the ash openings 42 and 142 may be discharged through a single opening. After all of the ashes have been removed from the fireplace and from the sweep surface 33, the lid member 55 may be swung rearward and downward to its closed position, as disclosed in FIGS. 1 and 4. The function of the lid member 55 enclosing the ash opening 42 is to conceal the sweep surface 33, which is usually still dirty or dusty. Moreover, the closed lid member 55 may prevent unwanted articles from accidentally falling down the chute 44, or it could be used to prevent unwanted air from the exterior of the house from entering the house, particularly when no fire is burning in the fireplace.

As will be observed in FIG. 2, the ash disposal device 10 is particularly useful for providing an ash disposal opening and chute for a pre-manufactured heating apparatus such as the steel insertable fireplace 13, and which would be difficult to modify after it has been installed in the fireplace chamber 12. Nevertheless, as previously mentioned, the ash disposal device 10 can be successfully used with various types of fireplaces, including the conventional brick or masonry fireplaces.

What is claimed is:

1. A fireplace ash disposal device comprising:

(a) a building comprising a sub-floor structure at a predetermiend elevation, (b) a fireplace in said building having a front opening and a fireplace floor supported on said sub-floor structure, (c) an elongated base member having an elongated top planar sweep surface substantially as long as the width of said front opening of said fireplace adjacent said fireplace floor, (d) support means mounting said base member along the front portion of said fireplace floor so that said sweep surface is substantially coplanar with said fireplace floor, (e) an ash opening in said sweep surface, (f) an elongated chute having one end in open communication with said ash opening and another open ash discharge end below said base member, (g) an elongated planar lid member having an elongated front edge portion and adapted to fit flush against said sweep surface, and (h) hinge means connecting said front edge portion of said lid member to said base member in front or said ash opening, to permit said lid member to swing between a closed position in which said lid member fits flush against said sweep surface and over said ash opening and an open position in which said lid member projects upward from said sweep surface to provide a barrier to ashes swept forward over said sweep surface and toward said ash opening.

2. The invention according to claim 1 further comprising a plurality of ash openings in said sweep surface and a plurality of said elongated chutes, each of said chutes having its one end in open communication with a corresponding ash opening, and said elongated planar lid member being long enough to extend over all said ash openings in said closed position.

3. The invention according to claim 1 in which the length of said lid member is substantially equal to the length of said sweep surface, said lid member and said sweep surface being co-extensive.

4. The invention according to claim 1 in which said support means comprises frame members fixed to said base member and adapted to be secured to said sub-floor structure below said fireplace.

5. The invention according to claim 4 in which said support means further comprises an attachment member fixed to said chute for securing to said sub-floor structure.

6. The invention according to claim 4 in which said base member is an elongated angle member, the top flange of said angle member forming said sweep surface, said mounting frame members being fixed to the depending flange of said angle member.

7. The invention according to claim 1 further comprising a handle member on the top surface of said lid member.

8. The invention according to claim 1 in which said chute comprises an upper vertical chute section including said one end in open communication with said ash opening and a lower rearward projecting chute section including said open ash discharge end.

* * * * *